US006166589A

United States Patent [19]

Park

[11] Patent Number: 6,166,589

[45] Date of Patent: Dec. 26, 2000

[54] REFERENCE VOLTAGE GENERATOR CIRCUIT FOR AN INTEGRATED CIRCUIT DEVICE

[75] Inventor: Jong-Min Park, Suwon, Rep. of Korea

[73] Assignee: Samsung Electronics, Co., Ltd., Suwon, Rep. of Korea

[21] Appl. No.: 09/389,678

[22] Filed: Sep. 2, 1999

[30] Foreign Application Priority Data

Sep. 2, 1998 [KR] Rep. of Korea ..... 98-36100

[51] Int. Cl.[7] ..... G05F 1/10

[52] U.S. Cl. ..... 327/540; 327/525

[58] Field of Search ..... 327/538, 540, 327/541, 530, 525

[56] References Cited

U.S. PATENT DOCUMENTS 5,706,240 1/1998 Fiocchi et al. ..... 327/541

6,091,282 7/2000 Kim ..... 327/540

*Primary Examiner*—Jung Ho Kim

*Attorney, Agent, or Firm*—Marger Johnson & McCollom, P.C.

[57] ABSTRACT

The present invention relates to a reference voltage generator circuit for a semiconductor device that enables generating a reference voltage considering various parameters such as temperature variation. There is provided a reference voltage generator circuit coupled between a power supply voltage and a ground voltage for generating a reference voltage responsive to a plurality of current path control signals. A control circuit generates the plurality of the current path control signals. The control circuit includes a voltage division circuit coupled between the power supply voltage and the ground voltage for generating a divided voltage responsive to a plurality of externally applied code signals. A comparison circuit compares the divided voltage and the reference voltage and generates a comparison signal as a result of the comparison. An output circuit receives the comparison signal from the comparison circuit responsive to the plurality of the code signals and generates the plurality of the current path control signals.

9 Claims, 3 Drawing Sheets

200
54
TRIM0
TRIM1
TRIM2
TRIM3
20
21
22
23
IV13
IV14
IV16
IV17
IV19
IV20
IV22
IV23
TG11
IV12
TG12
IV15
TG13
IV18
TG14
IV21
30
31
32
33
CODE0
CODE1
CODE2
CODE3
IV11
COM
Vref1
52
Vcc
Vss
Vcc
Vreftrim
50
Vcc
R21
R22
R23
R24
R25
MN21
MN22
MN23
MN24
Vss
Vss
Vss
Vss
CODE3
CODE2
CODE1
CODE0

REFERENCE VOLTAGE GENERATOR CIRCUIT FOR AN INTEGRATED CIRCUIT DEVICE

FIELD OF THE INVENTION

The present invention relates to a reference voltage generator circuit and, more particularly, to a reference voltage generator circuit for a memory device.

BACKGROUND OF THE INVENTION

There are many applications for reference voltage generator circuits that are stable regardless of changes in ambient temperature and supply voltage. Such devices have application in oscillator, timer, and voltage regulation circuitry.

FIG. 1 is a circuit diagram of a conventional reference voltage generator circuit. As shown in the drawing, the conventional reference voltage generator circuit has a plurality of resistors R1~R4 serially coupled to a power source voltage Vcc. A plurality of NMOS transistors MN1~MN3 is coupled between the plurality of resistors R1~R4 and a ground voltage Vss. The plurality of NMOS transistors MN1~MN3 function as resistors.

A PMOS transistor MP1 compensates for the threshold voltage of the NMOS transistors MN1~MN3 according to temperature variations. The PMOS transistor MP1 controls the reference voltage Vref according to the voltage across the resistors R3 and R4 and the NMOS transistors MN2 and MN3. That is, when fuses f1~f4 are cut by a laser beam, for example, the power supply voltage Vcc is applied to the resistors R3 and R4 or the NMOS transistor MN2 and MN3 such that the voltage at node N1 is lowered. If the voltage at node N1 is lower, the gate voltage of the PMOS transistor MP1 is lowered and the PMOS transistor MP1 operates weakly. Thus, the reference voltage Vref is controlled. The plurality of fuses f1~f4 is parallely coupled to each resistor R3 and R4 and each NMOS transistor MN2 and MN3. The fuses f1~f4 are selectively cut by the laser beam in order to obtain the desired reference voltage Vref.

The reference voltage Vref is changed by various factors present during the manufacturing process like temperature variation that make it difficult to accurately cut the fuses.

When a wafer goes through electric die sorting (EDS), the reference voltage Vref is typically compared with a target voltage. The target voltage is the desired design voltage. After comparing the two voltages, the fuses are cut by the laser beam when the two voltages are the same.

Thus, the EDS operation is performed in two steps: a measuring step wherein various parameters such as the reference voltage is measured and a determining step wherein the device is passed or failed after the fuse is shut off based on the various parameters.

After performing the above described two steps, the device is repaired. As a result, the EDS process increases the total sorting time because the device is tested several times with the incorrect shut-off of the fuse thereby generating a low device yield and a consequent high cost.

SUMMARY OF THE INVENTION

It is an object of the present invention to overcome the problems associated with prior art reference voltage generator circuits.

It is another object of the present invention to provide a reference voltage generator circuit for a semiconductor device that provides a reference voltage that considers various parameters such as temperature.

It yet is another object of the present invention to provide a reference voltage generator circuit for the semiconductor device that conveniently sets the reference voltage generating a high yield and lowering costs.

In order to attain the above objects, there is provided a reference voltage generator circuit coupled between a power supply voltage and a ground voltage. The reference voltage generator circuit is coupled between a power supply voltage and a ground voltage. The reference generator circuit generates a reference voltage responsive to a plurality of current path control signals. A control circuit generates the plurality of the current path control signals. The control circuit includes a voltage division circuit coupled between the power supply voltage and the ground voltage. The voltage division circuit generates a divided voltage responsive to a plurality of code signals. A comparison circuit generates a comparison circuit by comparing the reference voltage with the divided voltage. An output circuit receives the comparison signal responsive to the plurality of code signals and generates the plurality of current path control signals.

The control circuit controls the reference voltage generating circuit to generate a second level of the reference voltage responsive to the current path control signal corresponding to the comparison signal.

The voltage division circuit comprises a plurality of serially-connected resistors coupled to the supply voltage and a plurality of NMOS transistors each having a drain coupled to one end of a corresponding resistor, a source coupled to the ground voltage, and a gate for externally receiving the corresponding code signal, the plurality of NMOS transistor is selectively operating the plurality of resistor responsive to the plurality of code signals.

The reference voltage generator circuit comprises a first node coupled to the power supply voltage and a second node coupled to the ground voltage. A plurality of resistors is serially coupled to the first node. A plurality of NMOS transistors is serially coupled between the plurality of resistors and the second node. A PMOS transistor compensates a threshold voltage of the NMOS transistor according to temperature variations and controls the reference voltage according to a voltage of the plurality of resistors and the plurality of NMOS transistors. A plurality of shut-off circuits are coupled in parallel to each resistor and each NMOS transistor and act as a temporary shut-off means responsive to the plurality of current path control signals.

Each shut-off circuit comprises a transfer gate circuit for controlling the current path responsive to a corresponding current path control signal. A current shut-off means is serially coupled to the transfer gate circuit. The current shut-off means is shut off after the transfer gate circuit is turned off by the corresponding current path control signal. The transfer gate circuit includes a PMOS transistor having a drain, a source, and a gate for receiving the current path control signal. An NMOS transistor has a drain and a source coupled in parallel to the drain and the source of the PMOS transistor and a gate for receiving the corresponding current path control signal through an inverter. The current shut-off means is a fuse.

The output circuit comprises a plurality of transfer circuits for transferring the comparison signal to the reference voltage generating circuit responsive to the plurality of code signals.

Each transfer circuit comprises a transfer gate circuit for transferring the comparison signal responsive to a corresponding code signal and a latch circuit coupled to the transfer gate circuit for latching the comparison signal and providing the comparison signal to the reference voltage generating circuit. The transfer gate circuit includes an NMOS transistor having a drain, a source, and a gate for receiving the corresponding code signal. A PMOS transistor having a drain and a source coupled in parallel to the drain and the source of the PMOS transistor and a gate for receiving the corresponding code signal through an inverter. The latch circuit generates the current path control signal when the code signal is active.

One advantage of the present invention is that the reference voltage is set using externally applied code signals after considering various process parameters such as temperature variations. The result is a decrease in total sorting time.

BRIEF DESCRIPTION OF THE DRAWINGS

The foregoing and other objects, features, and advantages of the invention will become more readily apparent from the following detailed description of a preferred embodiment that proceeds with reference to the following drawings.

DESCRIPTION OF THE PREFERRED EMBODIMENT

Figure 1:
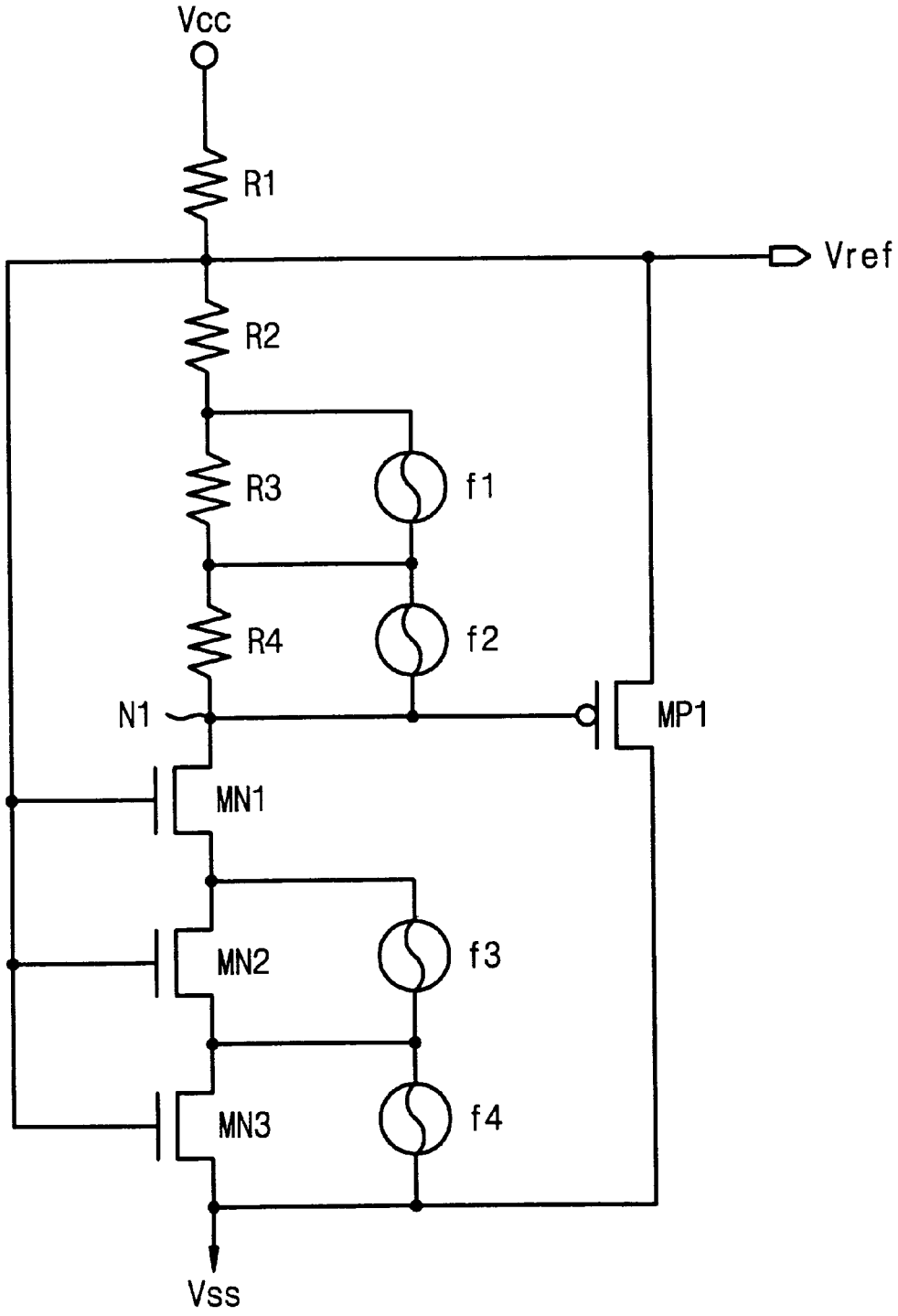
Fig. 1 (Prior Art)
FIG. 1 is a circuit diagram of a conventional reference voltage generator circuit.
Figure 2:
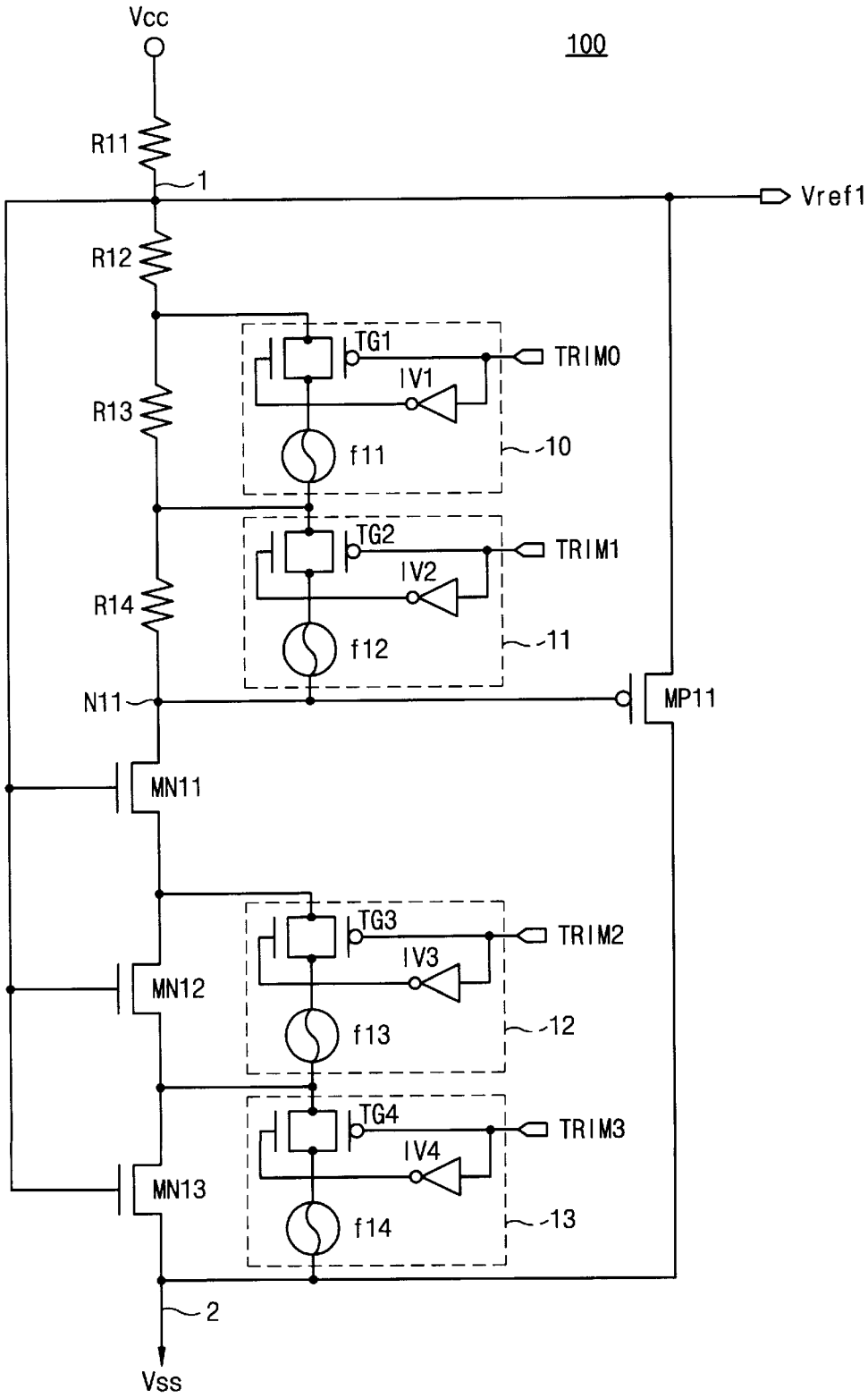
FIG. 2 is a circuit diagram of a reference voltage generator circuit in accordance with a present invention.
Figure 3:
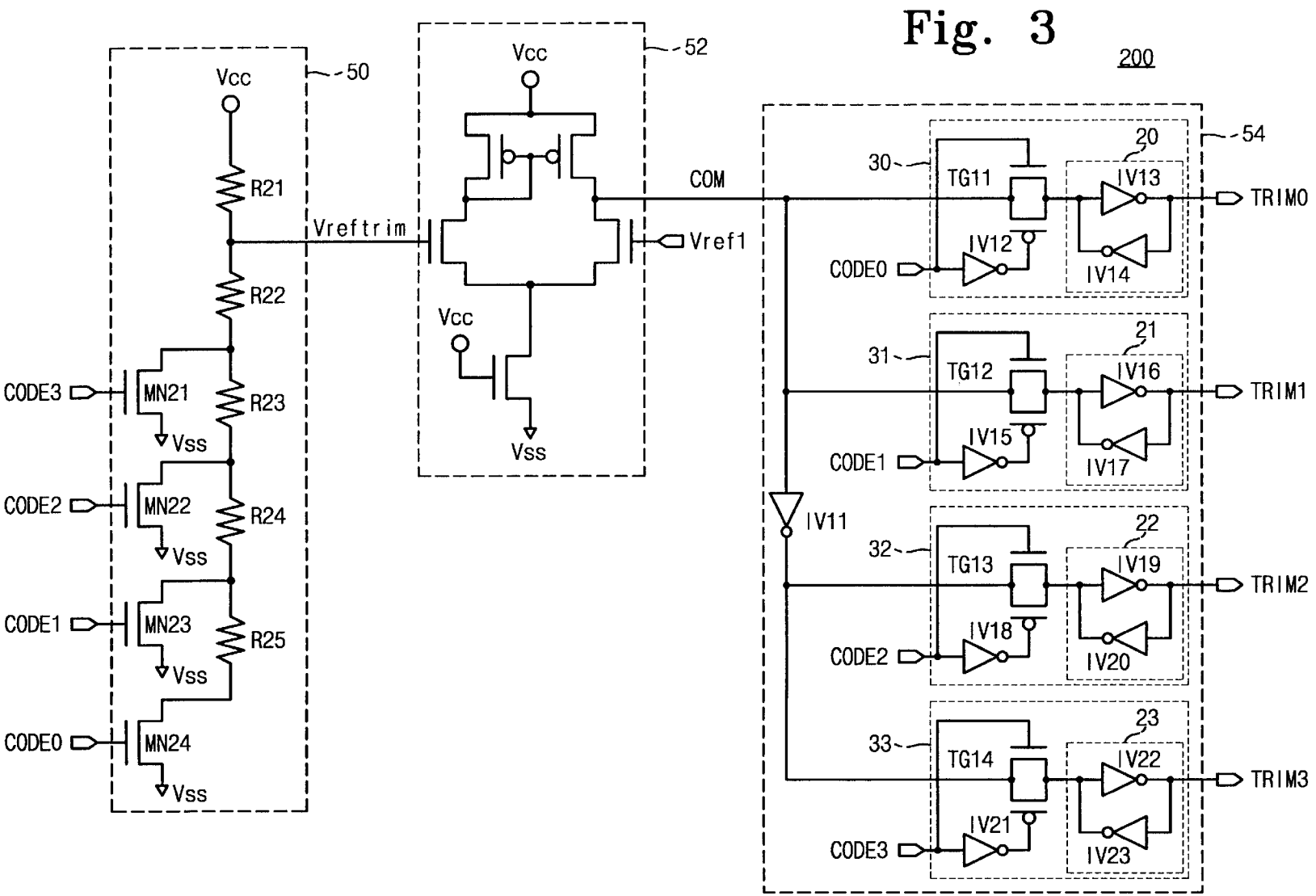
FIG. 3 is a circuit diagram of a control circuit for generating a plurality of current path control signals.

FIG. 2 is a circuit diagram of a reference voltage generator circuit in accordance with a present invention. FIG. 3 is a circuit diagram of a control circuit for generating a plurality of current path control signals. The reference voltage generator circuit comprises a reference voltage generating circuit 100 as shown and a control circuit 200 for generating a plurality of current path control signals TRIM0–TRIM3 as shown in FIG. 3.

The reference voltage generating circuit 100 is coupled between a power supply voltage Vcc and a ground voltage Vss and generates a reference voltage Vref1 in response to the plurality of current path control signals TRIM0~TRIM3.

The reference voltage generating circuit 100 includes a plurality of resistors R11~R14 serially coupled to a first node 1. The first node 1 is coupled to the power source voltage Vcc. A plurality of NMOS transistors MN11~MN13 are serially coupled between the plurality of the resistors R11~R14 and a second node 2. The plurality of NMOS transistors function as a resistor. The second node 2 is coupled to the ground voltage Vss.

A PMOS transistor MP11 compensates the threshold voltage of the NMOS transistors MN11~MN13 for temperature variations. A plurality of shut-off circuits 10~13 are parallely coupled to the resistors R13 and R14 and the NMOS transistors MN12 and MN13, respectively. The plurality of shut-off circuits 10~13 function as a shut-off means responsive to the externally applied plurality of the current path control signals TRIM0~TRIM3.

Each shut-off circuit 10~13 comprises a respective transfer gate circuit TG1~TG4, inverter IV1~IV4, and a fuse f11~f14. Each transfer gate circuit TG1~TG4 includes a PMOS transistor having a drain, a source, and a gate, the gate for receiving the corresponding current path control signals TRIM0~TRIM3. Each transfer gate circuit TG1~TG4 also includes an NMOS transistor having a drain and a source parallely coupled to the drain and source of the corresponding PMOS transistor, and a gate for receiving the current path control signals TRIM0~TRIM3 through the respective inverters IV1~IV4. The transfer gate circuits TG1~TG4 control the current path responsive to the current path control signals TRIM0~TRIM3.

The plurality of fuses f11~f14 is serially coupled to the transfer gate circuits TGI1~TG4. The fuses f1~f14 are cut by a laser beam to obtain the desired reference voltage Vref1. The fuses f11~f14 are selectively cut after the transfer gate circuits TG1~TG4 are turned off by the current path control signals TRIM0~TRIM3, respectively.

FIG. 3 is a circuit diagram of a control circuit for generating a plurality of current path control signals. The control circuit 200 for generating the plurality of current path control signals TRIM0~TRIM3 includes a voltage division circuit 50 coupled between the power supply voltage Vcc and the ground voltage Vss. The voltage division circuit 50 generates a divided voltage Vreftrim responsive to a plurality of externally applied code signals CODE0~CODE3. The plurality of code signals CODE0~CODE3 may be sequentially applied.

A comparison circuit 52 compares the reference voltage Vref1 with the divided voltage Vreftrim and generates a comparison signal COM as a result of the comparison. An output circuit 54 receives the comparison signal COM from the comparison circuit 52 responsive to the plurality of code signals CODE0~CODE3 and generates the plurality of current path control signals TRIM0~TRIM3.

The comparison circuit 52 compares the reference voltage Vref1 with the divided voltage Vreftrim repeatedly until the reference voltage Vrefl reaches the desired design voltage. The output circuit 54 has a plurality of transfer circuits 30~33 for transferring the comparison signal COM to the reference voltage generating circuit 100 responsive to the plurality of code signals CODE0~CODE3.

Each transfer circuit 30~33 includes a respective transfer gate circuit TG11~TG14 having a corresponding PMOS and NMOS transistors, and an inverter IV12, IV15, IV18, and IV 21, respectively, coupled between a gate of the corresponding PMOS transistor and an input port for receiving the code signal. The transfer circuits 30~33 transfer the comparison signal COM to the latch circuits 20~23 responsive to the externally applied code signals CODE0~CODE3. Each latch circuit 20~23 is coupled to a respective transfer gate circuit TG11~TG14, latches the comparison signal COM from the transfer gate circuits TG11~TG14, and provides the current path control signals TRIM0~TRIM3 to the reference voltage generating circuit 100. The latch circuits 20~23 generate the current path control signals TRIM0~TRIM3 when the code signals CODE0~CODE3 are active.

The voltage division circuit 50 has a plurality of resistors R21~R25 serially coupled to the power supply voltage Vcc. A plurality of NMOS transistor MN21~MN24 each have a drain coupled to one end of the resistors R22~R25, respectively, a source coupled to the ground voltage Vss, and a gate for externally receiving the code signals CODE0~CODE3. The plurality of NMOS transistor MN21~MN24 selectively operate the plurality of resistors R23~R25 responsive to the code signals CODE0~CODE3, respectively.

The control circuit 200 controls the reference voltage generating circuit 100. The control circuit 200 generates a second level voltage of the reference voltage Vref1 in accordance with the current path control signals TRIM0~TRIM3. The current path control signals TRIM0~TRIM3 correspond to the comparison signal COM generated by comparing a first level of the reference voltage Vref1 and the divided voltage Vreftrim.

The reference voltage generator circuit according to the present invention operates as follows. When the reference voltage generating circuit 100 generates a normal reference voltage, the current path control signals TRIM0~TRIM3 are at low signal levels. Assume that the target reference voltage is 1.2 V and the actual reference voltage is 1.35 V. The voltage division circuit 50 outputs the divided voltage Vreftrim according to the externally-applied code signals CODE0~CODE3. The code signals CODE0~CODE3 are used as an address decoding signal and sequentially change to a high level. Table 1 lists values for the divided voltage Vreftrim when each of the code signals CODE0~CODE3 changes to a high level.

TABLE 1

| | CODE0 | CODE1 | CODE2 | CODE3 |
|---|---|---|---|---|
| Vreftrim | 1.4 V | 1.3 V | 1.1 V | 1.0 V |

When the code signal CODE1 is at a high level, the divided voltage Vreftrim is a 1.3 V. This divided voltage Vreftrim (1.3 V) is provided to the comparison circuit 52 together with the actual reference voltage Vref1 (1.35 V). If the actual reference voltage Vref1 (1.35 V) is higher than the divided voltage Vreftrim (1.3 V), the comparison circuit 52 outputs a low level comparison signal COM. The output circuit 54 receives the low level comparison signal COM. Thereafter, the transfer gate circuit TG12 among the transfer gate circuits TG11~TG14 is turned on responsive to the code signals CODE0~CODE3 such that the low level comparison signal COM is transferred to the latch circuit 21. The latch circuit 21 transfers the comparison signal COM to the high level current path control signal TRIM1 such that the high level current path control signal TRIM1 is provided to the reference voltage generating circuit 100. Simultaneously, the low level current path control signals TRIM0, TRIM2, and TRIM3 responsive to the code signals CODEO, CODE2, and CODE3. respectively, such that the low level current path control signals TRIM0, TRIM2, and TRIM3 are provided to the reference voltage generating circuit 100.

Since the high level current path control signal TRIM1 and the low level current path control signals TRIM0, TRIM2, and TRIM3 are provided to the reference voltage generating circuit 100, the transfer gate circuit TG2 is turned off and the transfer gate circuits TG1, TG3, and TG4 are turned on. Accordingly, the power supply voltage Vcc is applied to the ground voltage Vss through the resistor R11, the resistor R12, the shut-off circuit 10, the resistor R14, the NMOS transistor MN11, the shut-off circuit 12, and the shut-off circuit 13. Since the shut-off circuit 11 is turned off, the power supply voltage Vcc is applied to the resistor R14 such that the voltage of the node N11 is lowered. This results in lowering the gate voltage of the PMOS transistor MP1 and operating the PMOS transistor MP1 weakly. Accordingly, the power supply voltage Vcc is applied to the ground voltage Vss through the resistor R11 and the source and the drain of the PMOS transistor MP11. The power supply voltage Vcc is lowered by the action of PMOS transistor MP11 lowering the reference voltage Vref1. Therefore, the reference voltage Vref1 reaches approximately the target voltage (1.2 V). After the reference voltage Vref1 receives the target voltage, the fuse f12 of the shut-off circuit 11 is cut such that the reference voltage Vref1 is permanently set.

One advantage of the reference voltage generator circuit of the present invention is that the target reference voltage is obtained by the externally applied code signals thereby decreasing the total sorting time. Additionally, the target reference voltage is set conveniently increasing yield and decreasing costs.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A reference voltage generator circuit, comprising:

a reference voltage generator circuit coupled between a power supply voltage and a ground voltage for generating a reference voltage responsive to a plurality of current path control signals; and a control circuit for generating the plurality of the current path control signals, the control circuit including:

a voltage division circuit coupled between the power supply voltage and the ground voltage for generating a divided voltage responsive to a plurality of code signals;

a comparison circuit for generating a comparison signal by comparing the reference voltage with the divided voltage to the divided voltage; and an output circuit for receiving the comparison signal responsive to the plurality of code signals and for generating the plurality of current path control signals.

2. The reference voltage generator circuit of claim 1 wherein the control circuit controls the reference voltage generating circuit generating a second level of the reference voltage responsive to a current path control signal corresponding to the comparison signal.

3. The reference voltage generator circuit of claim 1 wherein the voltage division circuit comprises:

a plurality of serially-connected resistors coupled to the supply voltage; and a plurality of NMOS transistors each having a drain coupled to one end of a corresponding resistor, a source coupled to the ground voltage, and a gate for externally receiving the corresponding code signal, the plurality of NMOS transistors being selectively operated by the plurality of resistor responsive to the plurality of code signals.

4. The reference voltage generator circuit of claim 1 wherein the reference voltage generator circuit comprises:

a first node coupled to the power supply voltage;

a second node coupled to the ground voltage;

a plurality of resistors serially coupled to the first node;

a plurality of NMOS transistors serially coupled between the plurality of resistors and the second node;

a PMOS transistor for compensating a threshold voltage of the NMOS transistor according to temperature variations and for controlling the reference voltage according to a voltage of the plurality of resistors and the plurality of NMOS transistors; and a plurality of shut-off circuits parallely coupled to resistor and NMOS transistor acting as a temporary shut-off means responsive to the plurality of the current path control signals.

5. The reference voltage generator circuit of claim 4 wherein each shut-off circuit comprises:

a transfer gate circuit for controlling a current path responsive to a corresponding current path control signal; and a current shut-off means serially coupled to the transfer gate circuit, the current shut-off means being shut off after the transfer gate circuit is turned off by the corresponding current path control signal;

wherein the transfer gate circuit includes:

a PMOS transistor having a drain, a source, and a gate for receiving the corresponding current path control signal; and an NMOS transistor having a drain and a source coupled in parallel to the drain and the source of the PMOS transistor and a gate for receiving the corresponding current path control signal through an inverter.

6. The reference voltage generator circuit of claim 5 wherein the current shut-off means is a fuse.

7. The reference voltage generator circuit of claim 1 wherein the output circuit comprises a plurality of transfer circuits for transferring the comparison signal to the reference voltage generating circuit responsive to the plurality of code signals.

8. The reference voltage generator circuit of claim 7 wherein the transfer circuit comprises:

a transfer gate circuit for transferring the comparison signal responsive to a corresponding code signal; and a latch circuit coupled to the transfer gate circuit for latching the comparison signal and providing the comparison signal to the reference voltage generating circuit;

wherein the transfer gate circuit includes:

an NMOS transistor having a drain, a source, and a gate for receiving the corresponding code signal; and a PMOS transistor having a drain and a source coupled in parallel to the drain and the source of the PMOS transistor and a gate for receiving the corresponding code signal through an inverter.

9. The reference voltage generator circuit of claim 8 wherein the latch circuit generates the current path control signal responsive to the corresponding code signal.

* * * * *

UNITED STATES PATENT AND TRADEMARK OFFICE

CERTIFICATE OF CORRECTION

PATENT NO. : 6,166,589
DATED : December 26, 2000
INVENTOR(S) : Park

It is certified that error appears in the above-identified patent and that said Letters Patent is hereby corrected as shown below:

Column 4,
Line 8, "TGI1~TG4" should read -- TG1~TG4 --.
Line 8, "f1~f14" should read -- fl 1~f14 --.
Line 33, "Vrefl" should read -- Vrefl --.

Signed and Sealed this

Sixth Day of August, 2002

*Attest:*

*Attesting Officer*

JAMES E. ROGAN
*Director of the United States Patent and Trademark Office*